US008596035B2

(12) United States Patent
Mowill

(10) Patent No.: US 8,596,035 B2
(45) Date of Patent: Dec. 3, 2013

(54) APPARATUS AND METHOD FOR REDUCING AIR MASS FLOW FOR EXTENDED RANGE LOW EMISSIONS COMBUSTION FOR SINGLE SHAFT GAS TURBINES

(75) Inventor: R. Jan Mowill, Hengelo (NL)

(73) Assignee: Opra Technologies B.V. (NL)

( * ) Notice: Subject to any disclaimer, the term of this patent is extended or adjusted under 35 U.S.C. 154(b) by 287 days.

(21) Appl. No.: 13/171,538

(22) Filed: Jun. 29, 2011

(65) Prior Publication Data

US 2013/0000315 A1 Jan. 3, 2013

(51) Int. Cl.

| | |
|---|---|
| ***F02C 7/057*** | (2006.01) |
| ***F02C 9/00*** | (2006.01) |
| ***F02G 3/00*** | (2006.01) |
| ***F23R 3/26*** | (2006.01) |

(52) U.S. Cl.

USPC ..... 60/39.23; 60/772; 60/240; 60/782; 60/785; 60/779; 415/1; 415/144; 415/145; 415/58.4; 415/58.5

(58) Field of Classification Search

USPC ..... 60/39.23, 772, 240, 782, 785, 779, 60/39.091, 39.1; 415/1, 144, 145, 58.5, 415/58.4

See application file for complete search history.

(56) References Cited

U.S. PATENT DOCUMENTS

| | | | | |
|---|---|---|---|---|
| 4,222,703 | A * | 9/1980 | Schaum et al. | 415/58.1 |
| 4,981,018 | A * | 1/1991 | Jones et al. | 60/726 |
| 5,235,803 | A * | 8/1993 | Rodgers | 60/785 |
| 5,236,301 | A | 8/1993 | Palmer | |
| 5,458,457 | A | 10/1995 | Goto et al. | |
| 5,657,631 | A | 8/1997 | Androsov | |
| 5,749,217 | A | 5/1998 | Etheridge | |
| 5,896,741 | A | 4/1999 | Etheridge | |
| 5,996,331 | A * | 12/1999 | Palmer | 60/782 |
| 6,164,074 | A | 12/2000 | Madden et al. | |
| 6,389,815 | B1 | 5/2002 | Hura et al. | |
| 7,520,745 | B2 | 4/2009 | Oomens et al. | |
| 7,775,759 | B2 * | 8/2010 | Sirakov et al. | 415/1 |
| 8,122,724 | B2 * | 2/2012 | Slovisky et al. | 60/772 |
| 2007/0217902 | A1 | 9/2007 | Sirakov et al. | |
| 2008/0038112 | A1 | 2/2008 | Spakovszky et al. | |
| 2008/0232952 | A1 * | 9/2008 | Gu et al. | 415/11 |

FOREIGN PATENT DOCUMENTS

| | | |
|---|---|---|
| WO | WO 2008/045063 A1 | 4/2008 |
| WO | WO 2010/059447 A2 | 5/2010 |

OTHER PUBLICATIONS

PCT International Search Report and Written Opinion for International Application No. PCT/IB2012/001522, dated Jun. 6, 2013.

* cited by examiner

*Primary Examiner* — Phutthiwat Wongwian
*Assistant Examiner* — Craig Kim
(74) *Attorney, Agent, or Firm* — Finnegan LLP

(57) ABSTRACT

Apparatus for reducing air mass flow through the compressor in a single shaft gas turbine engine having an extended operating range including part load conditions, to provide low emissions combustion. The apparatus includes one or more nozzles positioned for injecting compressed air into the inlet region of the compressor. The nozzles are oriented to direct the compressed air tangentially to, and in the same angular direction as, the direction of rotation to create a swirl in the inlet air flow to the compressor inducer. The apparatus also includes conduits in flow communication between the compressor diffuser and the nozzles, one or more valves operatively connected to control the flow of compressed air from the diffuser to the nozzles, and a controller operatively connected to the valves to cause compressed air flow to the nozzles during operation at part load conditions.

20 Claims, 3 Drawing Sheets

APPARATUS AND METHOD FOR REDUCING AIR MASS FLOW FOR EXTENDED RANGE LOW EMISSIONS COMBUSTION FOR SINGLE SHAFT GAS TURBINES

FIELD OF THE INVENTION

The present invention involves single shaft gas turbine engines. More specifically, the present invention involves low emission single shaft gas turbine engines operable over a range of loads including full (100%) load and part load.

BACKGROUND OF THE INVENTION

Gas turbine engines requiring low emissions over normal operating ranges between 100% ("full load") and part load (e.g. about 70% of full load) can achieve this in three basic ways, all by reducing air mass flow into the combustor in order to maintain an acceptable fuel/air radio without producing excessive poisonous CO gas caused by ultra lean combustion.

First, by use of so called two shaft turbine engines having a gas generator module and a power module each with separate, rotatably independent shafts, the gas generator module is purposefully controlled to have a reduced speed and thereby automatically a reduced air mass flow at part load.

Second, single shaft turbine engines can be configured to dump a fraction of the air mass flow from the compressor overboard, upstream of the combustor, at the expense of overall efficiency, or to bypass the combustors with part of the air mass flow and re-inject it in front of the turbine, thereby conserving the energy of the compressed air.

The third way to reduce air mass flow at part load conditions is to throttle the air going into the compressor by using moveable inlet guide vanes, to direct the inlet air into a swirl in the direction of rotation of the inducer position of a centrifugal compressor or the first stage of an axial compressor.

SUMMARY OF THE INVENTION

The current invention accomplishes reduced air mass flow into the combustor aerodynamically, without inlet guide vanes by injecting air jets generally tangentially into region adjacent to the compressor inlet in the direction of rotation, see FIG. 1. The jets can be placed at either or both the periphery or hub regions of the air intake, FIG. 2. One or more valves will open and shut the air to the jets on command from the engine control. The air mass flow through the jets would be drawn from the compressor outlet region and would be variable and amount to nominally within 10%-15% of the total air mass flow of the engine, depending on how much CO reduction would be needed. This invention will reduce compressor work, but will entail some losses due to the higher temperature of the jet air mixing with the air to be compressed. However, this is a small price in return for an apparatus and method that reduces cost of additional hardware, risk of ingestion of failed parts, and aerodynamic losses in conjunction with guide vanes when not in use, e.g., in full load conditions.

In accordance with one aspect of the invention, apparatus is provided for reducing air mass flow in a single shaft gas turbine engine having an extended operating range including part load conditions, the gas turbine engine having a rotating air compressor with an axis of rotation, an inlet region, and an outlet region. The apparatus includes at least one nozzle positioned for injecting compressed air into the inlet region. The nozzle is oriented to direct the compressed air tangentially to, and in the same angular direction as, the direction of rotation to create a swirl in an inlet air flow to the compressor. The apparatus also includes a source of compressed air in communication with the one or more nozzles, and one or more valves operatively connected to control the flow of compressed air to the one or more nozzles. The apparatus further includes a controller operatively connected to the one or more valves to cause compressed air flow to the one or more nozzles during operation at specified part load conditions.

In accordance with another aspect of the invention, a method for reducing air mass flow in a single shaft gas turbine engine over an extended operating range including part load conditions includes creating swirl in an inlet air mass flow by controllably injecting compressed air into the compressor inlet region generally tangential to, and in the same angular direction as, the direction of rotation during operation at part load conditions.

Additional aspects of the invention will be set forth in part in the description which follows, and in part will be obvious from the description, or may be learned by practice of the invention.

It is to be understood that both the foregoing general description and the following detailed description are exemplary and explanatory only and are not restrictive of the invention, as defined in the appended claims.

The accompanying drawings, which are incorporated in and constitute a part of this specification, illustrate several embodiments of the invention and together with the description, serve to explain the principles of the invention.

DESCRIPTION OF THE DISCLOSED EMBODIMENTS

Reference will now be made in detail to the exemplary embodiments of the invention illustrated in the accompanying drawings. Wherever possible, the same reference numbers will be used throughout the drawings to refer to the same or like parts.

Figure 1:
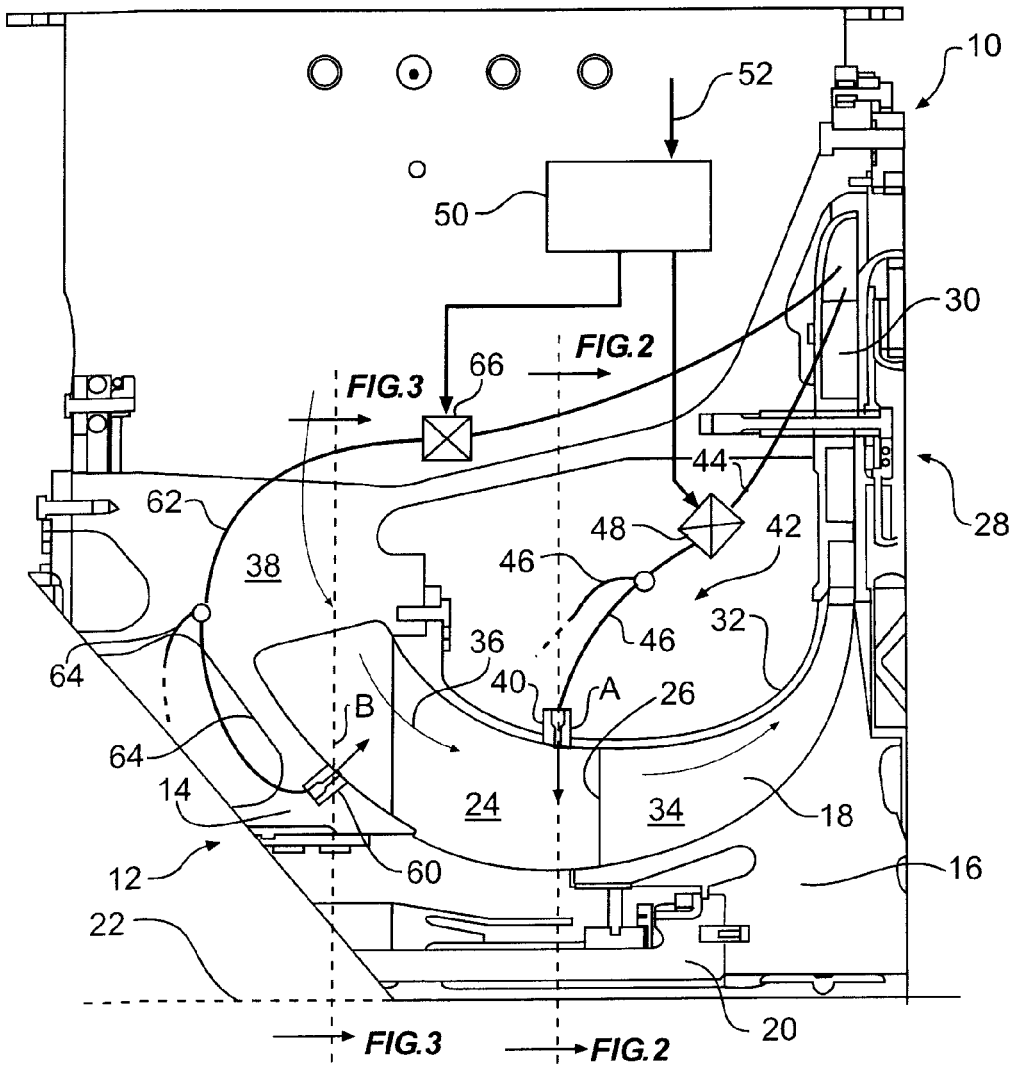
FIG. 1 is a schematic side cross section of the compressor portion of a single shaft radial gas turbine engine showing apparatus for throttling air mass flow into the compressor inlet.

Apparatus and methods of the present invention are intended for use with a single shaft gas turbine engine, that is, where a compressor component is driven at the same speed (RPM) as the driving turbine. FIG. 1 schematically depicts compressor 10 of such a single shaft engine. While not shown in FIG. 1, one of ordinary skill in the art would understand that compressor 10 would provide compressed air to a combustor (not shown) for combustion with fuel, with the resulting combustion gases being channeled to a turbine component. The turbine component (not shown) would extract power from the gases to drive compressor 10 and a suitable power takeoff apparatus e.g. an electric generator or hydraulic/pneumatic motor (also not shown).

Specifically, compressor 10 shown in FIG. 1 is a centrifugal compressor of the type having hub 12 with stator portion 14 and rotor portion 16. Rotor portion 16 mounts compressor blades 18 for rotation on shaft 20 about axis of rotation 22. Compressor 10 also includes an inlet region 24 upstream of inducer portion 26 of blades 18, and an outlet region 28 including diffuser 30. Compressor 10 further includes compressor shroud 32 defining in part air flow path 34 past compressor blades 18 and also air flow path 36 from an intake region 38 to inducer portion 26 of blades 18.

While compressor 10 as depicted in FIG. 1 is a centrifugal compressor, which may optionally be used in a gas turbine engine with a radial in-flow turbine (not shown), the present invention to be described hereinafter for reducing air mass flow at part loads may be used with an axial compressor in an axial flow gas turbine engine. Hence, the present invention is not intended to be limited to centrifugal compressors or engines with centrifugal compressors.

Figure 2:
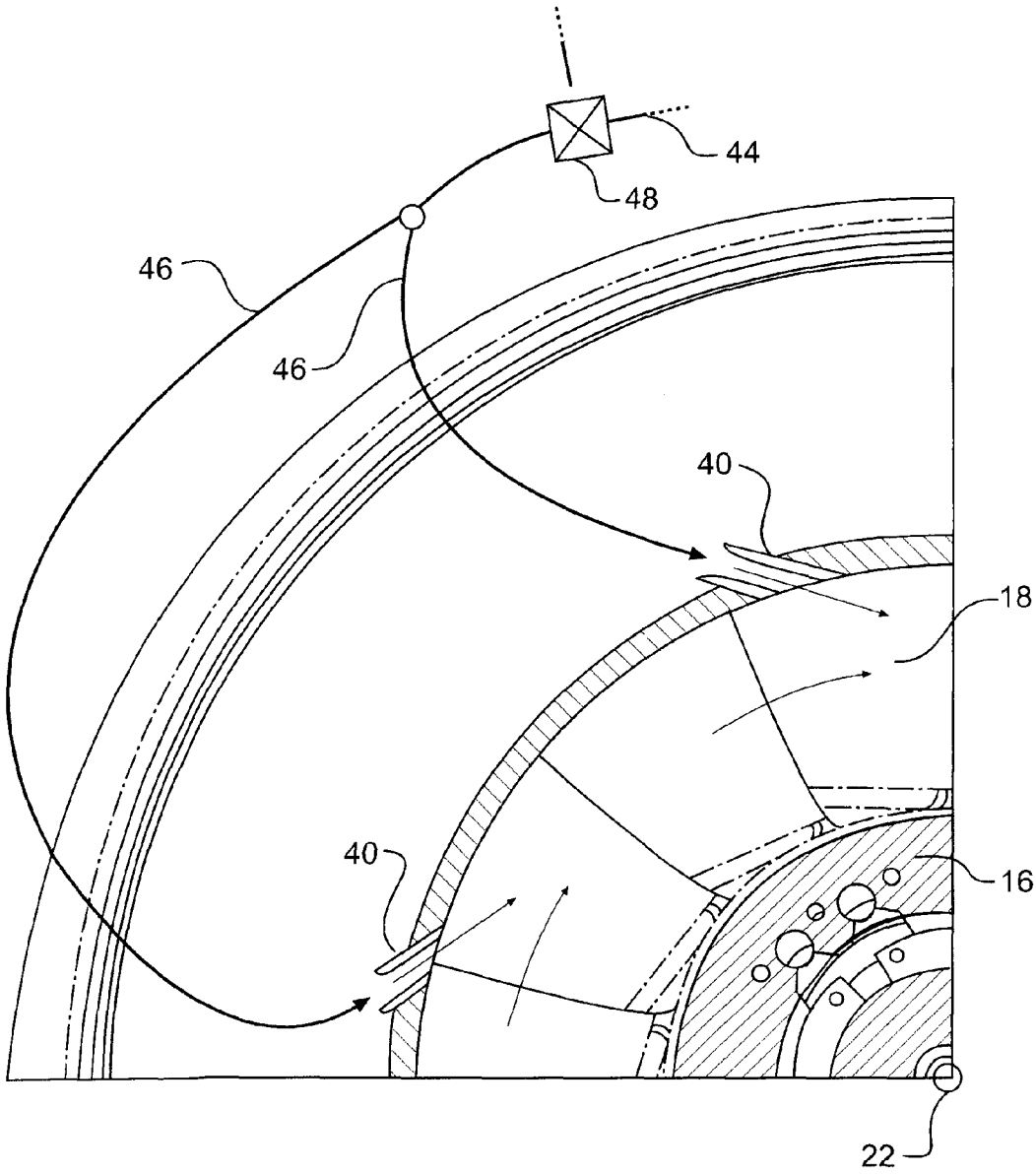
FIG. 2 is a schematic cross section through the axis of the compressor at FIG. 2-FIG. 2 in FIG. 1.

In accordance with the present invention, the apparatus for reducing air mass flow in a single shaft gas turbine engine having an extended operating range including part load conditions includes at least one nozzle positioned for injecting compressed air into the inlet region. The nozzle is oriented to direct the compressed air tangentially to, and in the same angular direction as, the direction of rotation to create a swirl in the inlet air flow to the compressor. As embodied herein and with reference to FIGS. 1 and 2, one or more nozzles 40 are mounted in shroud 32 at a position "A" in compressor inlet region 24 just upstream of inducer 26. While a single nozzle 40 theoretically could be used, it may be preferred to use 2-8 nozzles angularly distributed on shroud 32. Nozzles 40 are oriented to direct air tangentially into inlet region 24 in the same angular direction as the rotation of rotor 16 as depicted in FIG. 2.

Further in accordance with the present invention, the apparatus includes a source of compressed air in communication with one or more nozzles, one or more valves operatively connected to control the flow of compressed air to the one or more nozzles, and a controller operatively connected to the one or more valves to cause compressed air to flow to the one or more nozzles during engine operation at part load conditions.

In the depicted embodiments, compressed air is taken from compressor outlet region 28, such as from diffuser 30, and is channeled to nozzles 40 through conduits 42, which include a main conduit 44 from diffuser 30 and one or more branching conduits 46 feeding the individual nozzles 40. A single valve 48 is positioned in conduit 44, although multiple valves could be used in conduits 46. Valve 48, which may be an on-off or proportional type valve, is controlled by controller 50 having as an input a signal 52 representative of engine load. Controller 50 may be the engine controller or a separate control device.

It may be preferred to control compressed air to nozzles 40 during all or a fraction of the part load operating regime, such as e.g. in the range of from about 90% to about 70% of full load. It is anticipated that the compressed air flow rate would range from about 10% to about 15% of the compressor air mass flow rate at full load conditions in this range.

The intended effect of the compressed air injection is to create swirl in the inlet air incident on the inducer portion 26 of rotor 16. As the aspect of blades 18 typically is set to receive incoming air at a predetermined angle relative to axis 22 (generally at zero degrees), changing the angle of incidence of the incoming air via the swirl will make the compressor less efficient and thereby act to throttle the air mass flow. Nonetheless, overall operational performance over the engine part load power range is expected to improve through use of the present invention. Moreover, changing the amount of compressed air injected to achieve the desired swirl, such as by the use of a proportional valve for valve 48, may reduce the inefficiencies.

Figure 3:
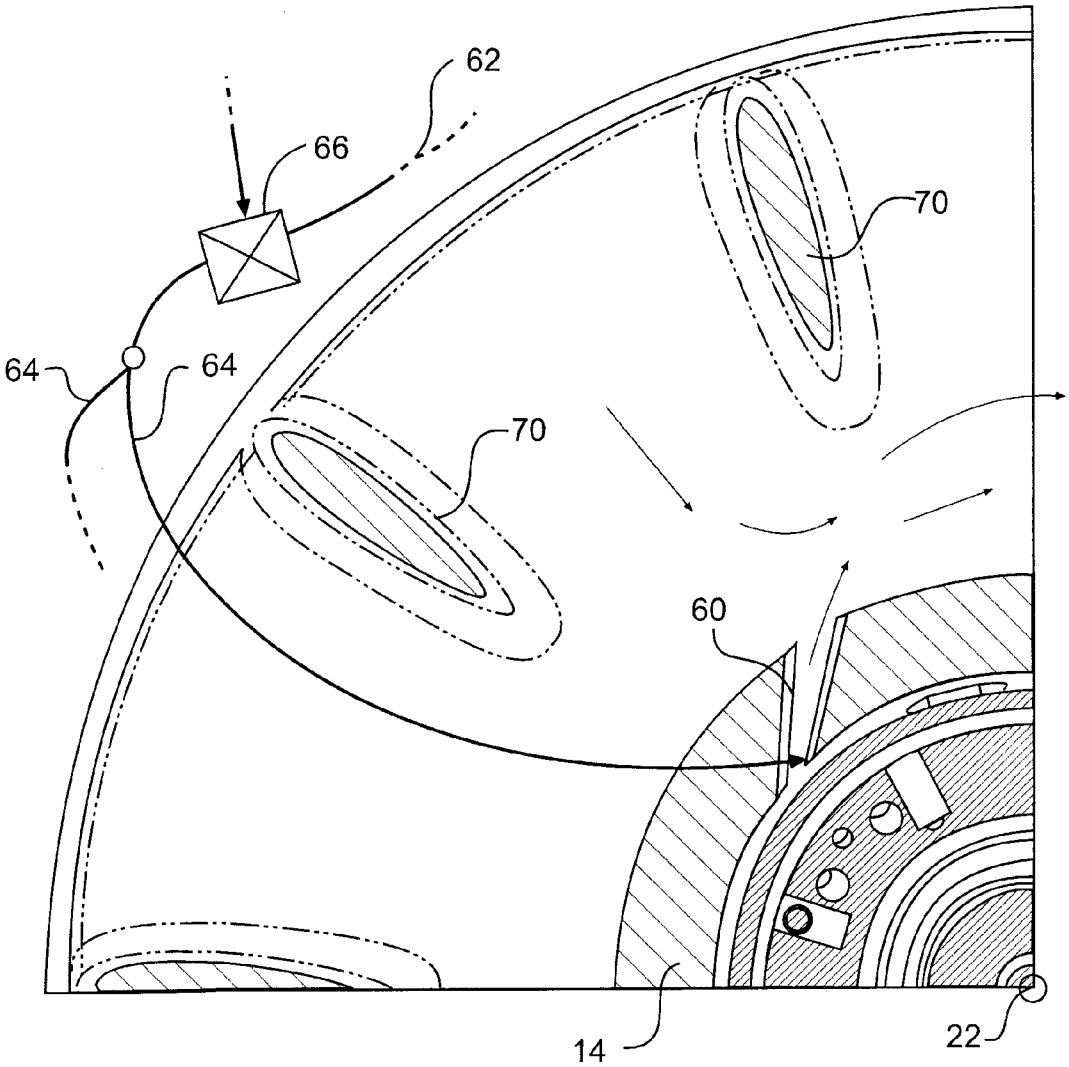
FIG. 3 is a schematic cross section through the axis of the compressor at FIG. 3-FIG. 3 in FIG. 1.

With attention to FIGS. 1 and 3 there is shown an alternative or additional configuration for the apparatus for reducing air mass flow through the compressor during part load engine operation. In such a configuration, the one or more nozzles 60 are mounted in hub stator 14 at position "B" in FIG. 1. Again, although a single nozzle 60 could be used, it may be preferred to use 2-8 angularly distributed nozzles 60. Nozzles 60 may be fed through a single conduit 62 from diffuser 30 and then through separate branching conduits 64 to the individual nozzles 60. A single valve 66 is positioned in conduit 62, but separate valves could be used to control the flow in conduits 64. The flow rate of compressed air is controlled according to load by valve 66 via signal from controller 50. If compressor 10 includes an intake having fixed inlet guide vanes (such as fixed inlet guide vanes 70 depicted in FIG. 3) then the position of nozzles 60 preferably should be downstream of inlet guide vanes 70. Again, nozzles 60 as depicted in FIG. 3, may be used as an alternative or in conjunction with nozzles 40 depicted in FIG. 2. If the apparatus includes both nozzles 40 and 60, then a single controller such as controller 50 depicted schematically in FIG. 1 may be used to control both sets of nozzles concurrently.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. Method for reducing air mass flow in a single shaft gas turbine engine, over an extended operating range including part load conditions, the gas turbine engine having a rotating air compressor with an axis of rotation, an inlet region and an outlet region, the method comprising:

creating swirl in inlet air mass flow by controllably injecting compressed air into the compressor inlet region generally tangential to said axis of rotation, and in the same angular direction as, the direction of rotation of the compressor during operation at part load conditions.

2. The method as in claim 1 further including extracting the compressed air to be injected from the compressor outlet region.

3. The method as in claim 1 wherein the compressed air is injected during engine operation between about 90% and about 70% of full load.

4. The method as in claim 1 wherein the flow rate of the injected compressed air is controlled by at least one valve acting in response to a turbine engine gas controller.

5. The method as in claim 4 wherein the valve is an on-off valve or a proportional valve.

6. The method as in claim 1, where in the compressor is a centrifugal compressor, the method further including extracting the compressed air from a diffuser in the compressor outlet region.

7. The method as in claim 1 wherein the flow rate of the injected compressed air is between greater than 0% and less than or equal to about 15% of the air mass flow through the compressor at full load condition.

8. The method as in claim 1, wherein the compressor includes an inlet shroud, and wherein the controllably injecting includes flowing the compressed air through one or more nozzles positioned in the inlet shroud.

9. The method as in claim 1 wherein the compressor includes an inlet stator hub, and wherein controllably injecting compressed air includes flowing the compressed air through at least one nozzle positioned in the inlet stator hub.

10. The method as in claim 8, wherein 2-8 angularly spaced-apart nozzles are used to inject the compressed air.

11. The method as in claim 9, wherein 2-8 angularly spaced-apart nozzles are used to inject the compressed air.

12. The method as in claim 8, wherein the compressor further includes an inlet stator hub, and wherein the controllably injecting compressed air also includes flowing the compressed air through at least one nozzle positioned in the inlet stator hub.

13. Apparatus for reducing air mass flow in a single shaft gas turbine engine having an extended operating range including part load conditions, the gas turbine engine having a compressor with an axis of rotation, an inlet region, and an outlet region, the apparatus comprising:

at least one nozzle positioned for injecting compressed air into the inlet region, the nozzle being oriented to direct the compressed air tangentially to said axis of rotation, and in the same angular direction as, the direction of rotation of the compressor to create a swirl in the inlet air flow to the compressor;

a source of compressed air in communication with the one or more nozzles; one or more valves operatively connected to control the flow of compressed air to the one or more nozzles; and a controller operatively connected to the one or more valves to cause compressed air flow to the one or more nozzles during engine operation at part load conditions.

14. The apparatus as in claim 13 wherein the gas turbine engine includes an engine controller, and wherein the engine controller also controls the compressed air flow.

15. The apparatus as in claim 13, where in the compressor is a centrifugal compressor, and wherein the source of compressed air is a diffuser in the outlet region of the compressor.

16. The apparatus as in claim 13 wherein the one or more valves is an on-off valve or a proportional valve.

17. The apparatus as in claim 13 wherein the controller is configured to provide compressed air injection between about 90% and about 70% part load conditions.

18. The apparatus as in claim 13 wherein the compressed air mass flow rate through the one or more nozzles is between about 10% and about 15% of a full load gas turbine engine air mass flow rate.

19. The apparatus as in claim 13 wherein the compressor includes an inlet shroud, and wherein the one or more nozzles includes 2-8 nozzles mounted in the inlet shroud.

20. The apparatus as in claim 13 wherein the compressor includes an inlet stator having a hub and wherein the one or more nozzles includes 2-8 nozzles mounted in the stator hub.

* * * * *